US008942611B2

(12) United States Patent
Sato et al.

(10) Patent No.: US 8,942,611 B2
(45) Date of Patent: Jan. 27, 2015

(54) FIXING DEVICE AND IMAGE FORMING APPARATUS

(71) Applicant: Fuji Xerox Co., Ltd., Minato-ku, Tokyo (JP)

(72) Inventors: Hideki Sato, Kanagawa (JP); Jun Sawamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 35 days.

(21) Appl. No.: 13/693,715

(22) Filed: Dec. 4, 2012

(65) Prior Publication Data

US 2013/0315637 A1 Nov. 28, 2013

(30) Foreign Application Priority Data

May 22, 2012 (JP) ..... 2012-116831

(51) Int. Cl.
*G03G 15/20* (2006.01)

(52) U.S. Cl.
CPC ..... *G03G 15/2085* (2013.01); *G03G 15/2053* (2013.01); *G03G 2215/2035* (2013.01)
USPC ..... 399/329; 399/328; 399/107

(58) Field of Classification Search
None
See application file for complete search history.

(56) References Cited

U.S. PATENT DOCUMENTS

| | | | | |
|---|---|---|---|---|
| 7,962,084 | B2 * | 6/2011 | Tanaka et al. | 399/329 |
| 8,543,045 | B2 * | 9/2013 | Arikawa et al. | 399/328 |
| 2005/0163542 | A1 * | 7/2005 | Gilmore et al. | 399/329 |
| 2012/0251206 | A1 * | 10/2012 | Nakamura et al. | 399/329 |

FOREIGN PATENT DOCUMENTS

JP 2006-058527 A 3/2006

* cited by examiner

*Primary Examiner* — Clayton E Laballe
*Assistant Examiner* — Ruifeng Pu
(74) *Attorney, Agent, or Firm* — Sughrue Mion, PLLC

(57) ABSTRACT

A fixing device includes: a fixing member that transports a recording medium on which a toner image has been transferred to fix the toner image to the recording medium; an endless belt member that rotates with a front surface of the belt member contacting the fixing member; a guide member that guides the belt member to a contact portion at which the belt member and the fixing member contact each other; plural rotational-direction projections formed on a guide surface of the guide member facing a back surface of the belt member and disposed at intervals in a rotational axis direction of the belt member, the rotational-direction projections extending in a rotational direction of the belt member and projecting toward the back surface; and an intersecting-direction projection formed on the guide surface, the intersecting-direction projection extending along an intersecting direction that intersects the rotational-direction projections and projecting toward the back surface.

10 Claims, 15 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2012-116831 filed May 22, 2012.

BACKGROUND

1. Technical Field

The present invention relates to a fixing device and an image forming apparatus.

2. Summary

According to an aspect of the present invention, there is provided a fixing device including: a fixing member that transports a recording medium on which a toner image has been transferred to fix the toner image to the recording medium; an endless belt member that rotates with a front surface of the belt member contacting the fixing member; a guide member that guides the belt member to a contact portion at which the belt member and the fixing member contact each other; plural rotational-direction projections formed on a guide surface of the guide member facing a back surface of the belt member and disposed at intervals in a rotational axis direction of the belt member, the rotational-direction projections extending in a rotational direction of the belt member and projecting toward the back surface of the belt member; and an intersecting-direction projection formed on the guide surface, the intersecting-direction projection extending along an intersecting direction that intersects the rotational-direction projections and projecting toward the back surface of the belt member.

BRIEF DESCRIPTION OF THE DRAWINGS

An exemplary embodiment of the present invention will be described in detail based on the following figures, wherein.

DETAILED DESCRIPTION

Figure 1:
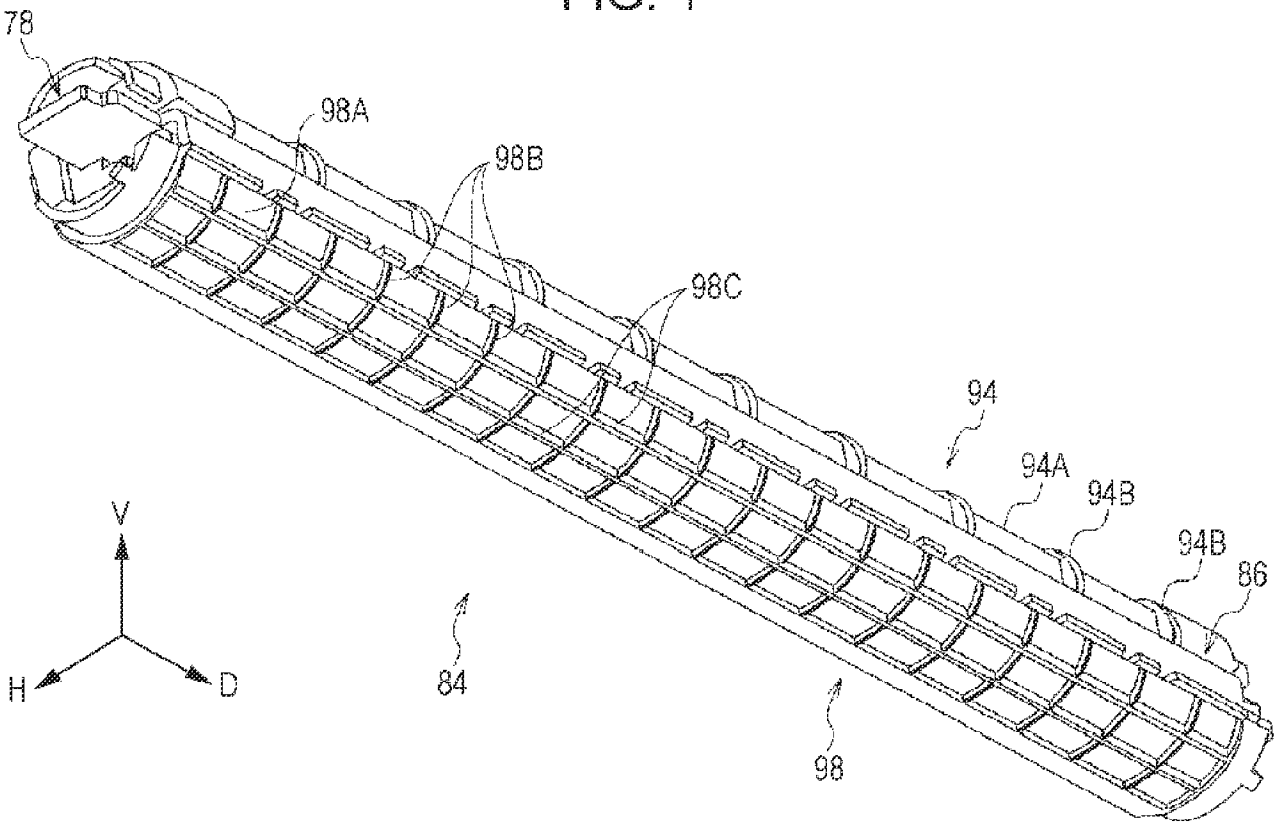
FIG. 1 is a perspective view showing a support mechanism forming a pressurizing member provided in a fixing device according to an exemplary embodiment of the present invention.

A fixing device according to an exemplary embodiment of the present invention and an example of an image forming apparatus including the fixing device will be described with reference to FIGS. 1 to 15. In the drawings, the arrow V indicates the vertical direction, the arrow H indicates a horizontal direction corresponding to the apparatus width direction, and the arrow D indicates a horizontal direction corresponding to the apparatus depth direction.

(Overall Configuration)

Figure 15:
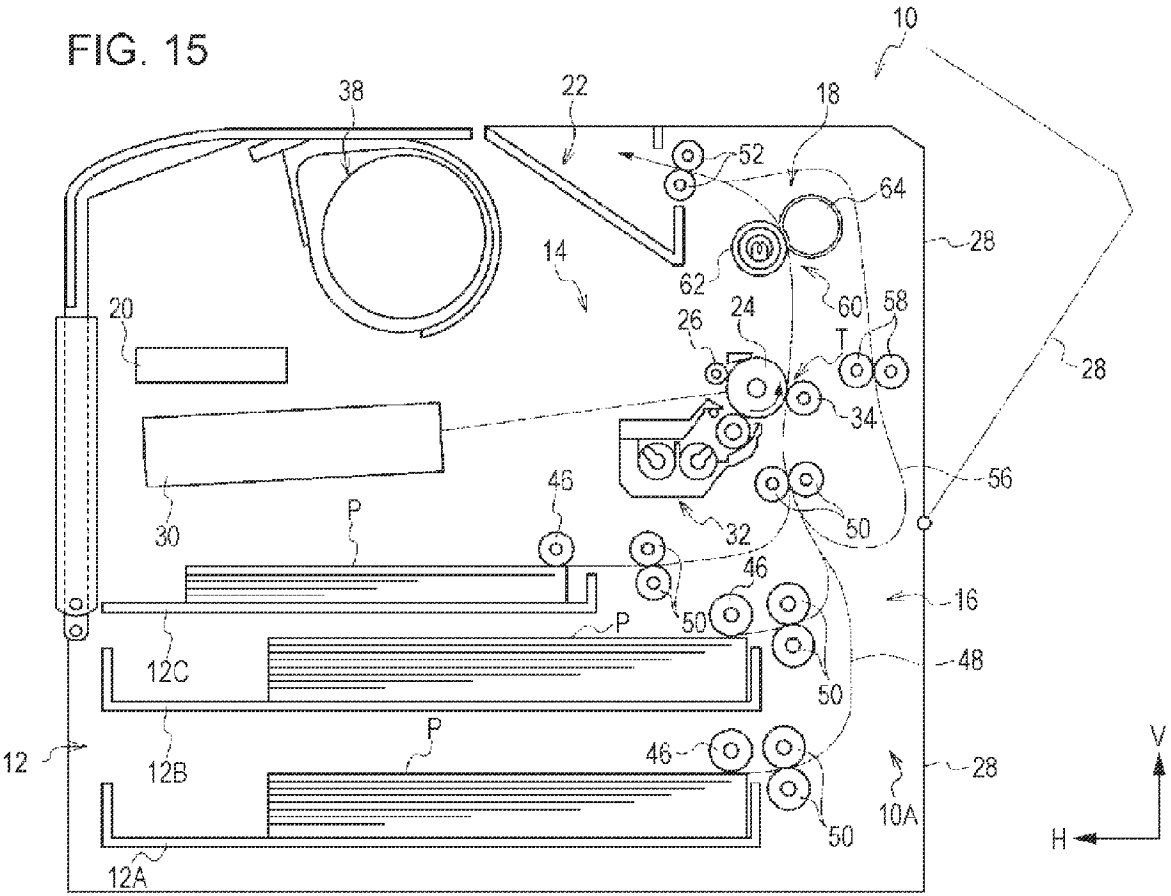
FIG. 15 shows a schematic configuration of an image forming apparatus according to the exemplary embodiment of the present invention.

As shown in FIG. 15, an image forming apparatus 10 includes an apparatus body 10A that houses therein constituent components of the image forming apparatus 10. A housing section 12, a transport section 16, an image forming section 14, a fixing section 18, and a controller 20 are provided inside the apparatus body 10A. The housing section 12 houses sheet members P serving as recording media. The transport section 16 transports the sheet member P housed in the housing section 12. The image forming section 14 forms a toner image on the sheet member P being transported. The fixing section 18 fixes the toner image formed on the sheet member P by the image forming section 14 to the sheet member P. The controller 20 controls operation of the various sections of the image forming apparatus 10.

An eject section 22 is formed in the upper portion of the apparatus body 10A. The eject section 22 ejects the sheet member P to which the image has been fixed by the fixing section 18.

[Image Forming Section]

The image forming section 14 is disposed around the middle in the apparatus body 10A in the vertical direction. The image forming section 14 includes an image holding element 24 that holds an image.

The image holding element 24 has a cylindrical shape, and rotates in one direction (counterclockwise in FIG. 15). A charging roller 26, an exposure device 30, a developing device 32, and a transfer roller 34 are disposed around the image holding element 24, and arranged in this order from the upstream side in the rotational direction of the image holding element 24. The charging roller 26 charges the image holding element 24. The exposure device 30 exposes the image holding element 24 charged by the charging roller 26 to light to form an electrostatic latent image on the image holding element 24. The developing device 32 develops the electrostatic latent image formed by the exposure device 30 to obtain a black, for example, toner image. The transfer roller 34 serves as an example of a transfer member that transfers the black toner image formed on the image holding element 24 by the developing device 32 to the sheet member P.

The transfer roller 34 is disposed to face the image holding element 24, and rotates with the sheet member P interposed between the transfer roller 34 and the image holding element 24 to transport the sheet member P upward. The point between the transfer roller 34 and the image holding element 24 is defined as a transfer position T at which the toner image formed on the image holding element 24 is transferred to the sheet member P.

A toner cartridge 38 containing toner is disposed above the exposure device 30. The image forming section 14 further includes a transport tube (not shown) that transports the toner contained in the toner cartridge 38 to the developing device 32.

[Housing Section]

The housing section 12 is disposed below the image forming section 14. The housing section 12 includes loading members 12A, 12B, and 12C arranged in the vertical direction to be loaded with the sheet members P. Each loading member 12A, 12B, 12C may be drawn toward the front side of the apparatus in the apparatus depth direction. The loading member 12A, 12B, 12C may be replenished with the sheet members P when the loading member 12A, 12B, 12C is drawn toward the front side of the apparatus.

[Transport Section]

The transport section 16 is disposed at a side of the housing section 12 and the image forming section 14. The transport section 16 includes a feed roller 46 and plural transport rollers 50. The feed roller 46 starts feeding the uppermost sheet member P stored in each loading member 12A, 12B, 12C. The transport rollers 50 transport the sheet member P fed by the feed roller 46 along a transport path 48 for the sheet member P.

The transport section 16 further includes eject rollers 52 that eject the sheet member P to which the toner image has been fixed by the fixing section 18 to the eject section 22.

The transport section 16 additionally includes transport rollers 58 that transport the sheet member P along a reverse transport path 56 in order to forward the sheet member P to one surface (front surface) of which the toner image has been fixed to the transfer position T again with the front and back sides of the sheet member P reversed.

The reverse transport path 56 is disposed opposite to the image holding element 24 with respect to the transfer roller 34. If images are to be formed on both surfaces of the sheet member P, the sheet member P to one side of which the toner image has been fixed is switched back by the eject rollers 52 to be guided to the reverse transport path 56. The sheet member P which has been guided is transported along the reverse transport path 56 by the transport rollers 58 to be turned over. Then, the sheet member P is forwarded to the transfer position T again.

[Fixing Section]

The fixing section 18 is disposed above the image forming section 14. The fixing section 18 includes a fixing device 60. The fixing device 60 includes a heating member 62 and a pressurizing member 64. The heating member 62 serves as an example of a fixing member that heats the toner image transferred to the sheet member P while being rotated by a rotational force transmitted from a motor (not shown). The pressurizing member 64 is rotationally driven through contact with the heating member 62 to transport the sheet member P interposed between the pressurizing member 64 and the heating member 62. The fixing device 60 will be discussed in detail later.

(Function of Overall Configuration)

Next, image forming operations for forming an image on the sheet member P will be described.

In the housing section 12 and the transport section 16, the sheet member P fed from any loading member 12A, 12B, 12C by the feed roller 46 is forwarded to the transfer position T by the plural transport rollers 50.

In the image forming section 14, the image holding element 24 is charged by the charging roller 26, and thereafter exposed to light by the exposure device 30 so that an electrostatic latent image is formed on the image holding element 24. The electrostatic latent image is developed by the developing device 32 so that a black toner image is formed on the image holding element 24. The black toner image is transferred by the transfer roller 34 to the sheet member P which has been transferred to the transfer position T.

The sheet member P to which the toner image has been transferred is transported to the fixing device 60 so that the toner image which has been transferred to the sheet member P is fixed by the fixing device 60 to the sheet member P. In the case where an image is to be formed only on one surface of the sheet member P, the sheet member P is ejected to the eject section 22 by the eject rollers 52 after the toner image is fixed to the sheet member P.

In the case where images are to be formed on both surfaces of the sheet member P, in contrast, the sheet member P is switched back by the eject rollers 52 to be forwarded to the reverse transport path 56 after the toner image is fixed to one surface (front surface) of the sheet member P. The sheet member P is turned over when the transport rollers 58 transport the sheet member P along the reverse transport path 56. Then, the sheet member P is forwarded from the reverse transport path 56 to the transfer position T again. A toner image is formed on the back surface of the sheet member P, on which no toner image has been recorded, in the same manner as on its front surface. The sheet member P is ejected to the eject section 22 by the eject rollers 52. A sequence of image forming operations is thus accomplished.

(Construction of Fixing Device)

Next, the fixing device 60 will be described.

The fixing device 60 is removable from the apparatus body 10A, and may be removed by opening a maintenance door 28 provided to the apparatus body 10A as shown in FIG. 15 (see the double-dashed line in FIG. 15). Each term used in the following description to refer to a direction indicates the direction with the fixing device 60 attached to the apparatus body 10A.

Figure 12:
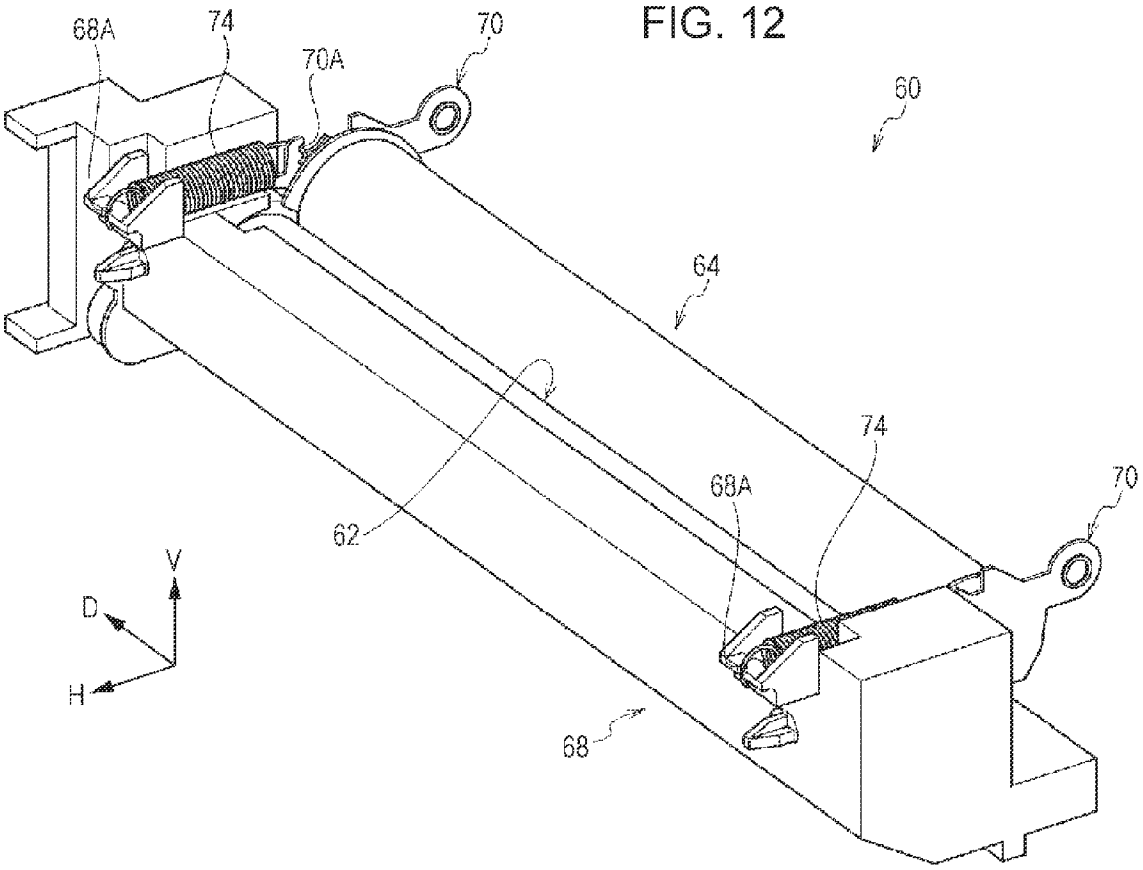
FIG. 12 is a perspective view showing the fixing device according to the exemplary embodiment of the present invention.
Figure 14:
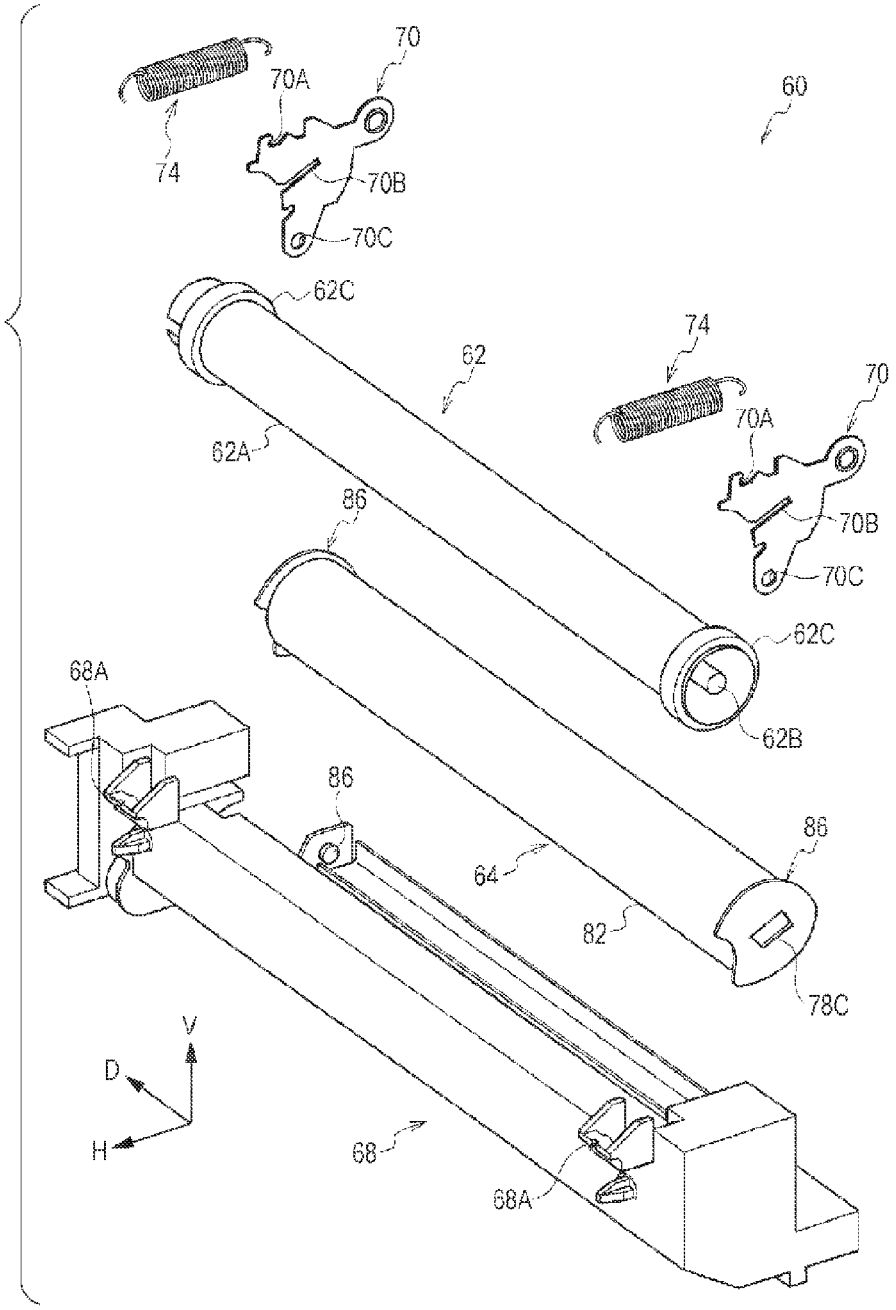
FIG. 14 is an exploded perspective view showing the fixing device according to the exemplary embodiment of the present invention.

As shown in FIGS. 12 and 14, the fixing device 60 includes the heating member 62 discussed earlier, a first support member 68, a pair of second support members 70, the pressurizing member 64 discussed earlier, and coil springs 74 (hereinafter simply referred to as "springs 74"). The first support member 68 supports the heating member 62. The pair of second support members 70 are supported by the first support member 68 so as to be movable with respect to the first support member 68. The pressurizing member 64 is supported by the pair of second support members 70. The springs 74 press the pressurizing member 64 against the heating member 62.

[Heating Member]

As shown in FIG. 14, the heating member 62 includes a cylindrical member 62A, a heating element 62B, and a pair of bearings 62C. The cylindrical member 62A has a cylindrical shape, and has a rotational axis extending in the apparatus depth direction. The heating element 62B is disposed inside the cylindrical member 62A. The pair of bearings 62C are disposed at both ends of the cylindrical member 62A in the apparatus depth direction.

[First Support Member and Spring]

The first support member 68 extends in the apparatus depth direction. A retaining portion 68A is formed at each end of the first support member 68 in the apparatus depth direction. One end of the spring 74 is retained (supported) at the retaining portion 68A. The other end of the spring 74 is retained at a retaining portion 70A formed in the second support member 70 to be discussed later. This allows the pressurizing member 64 supported by the second support members 70 to be urged by the urging forces of the springs 74 against the heating member 62 supported by the first support member 68.

Figure 9:
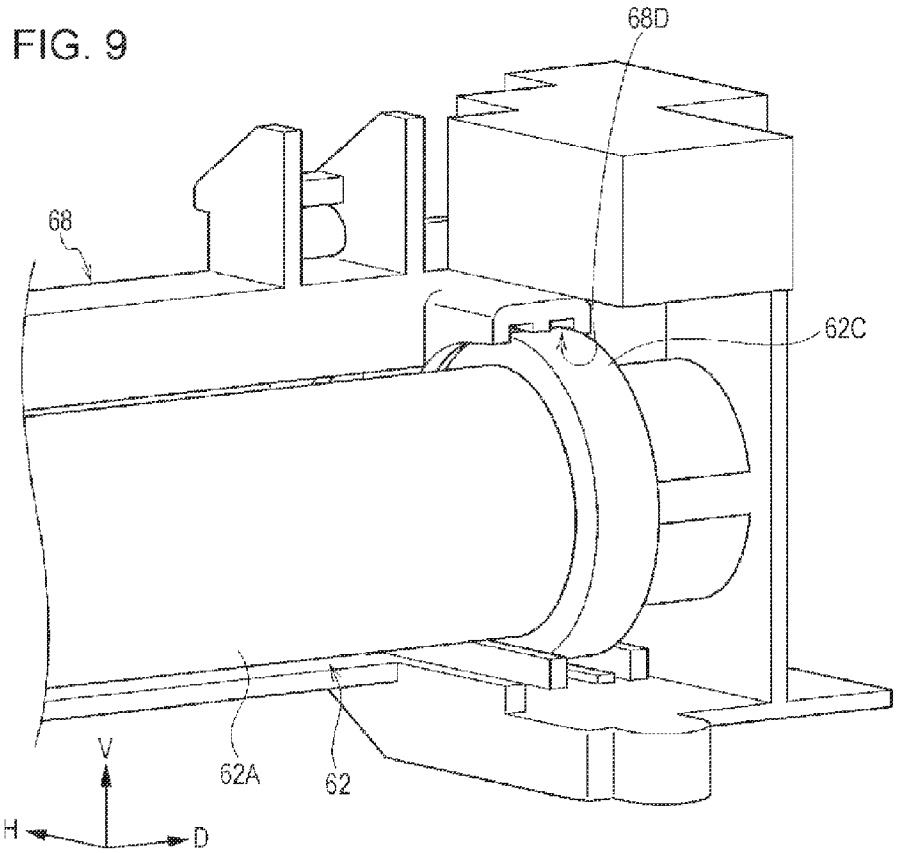
FIG. 9 is an enlarged perspective view showing the fixing device according to the exemplary embodiment of the present invention.
Figure 10:
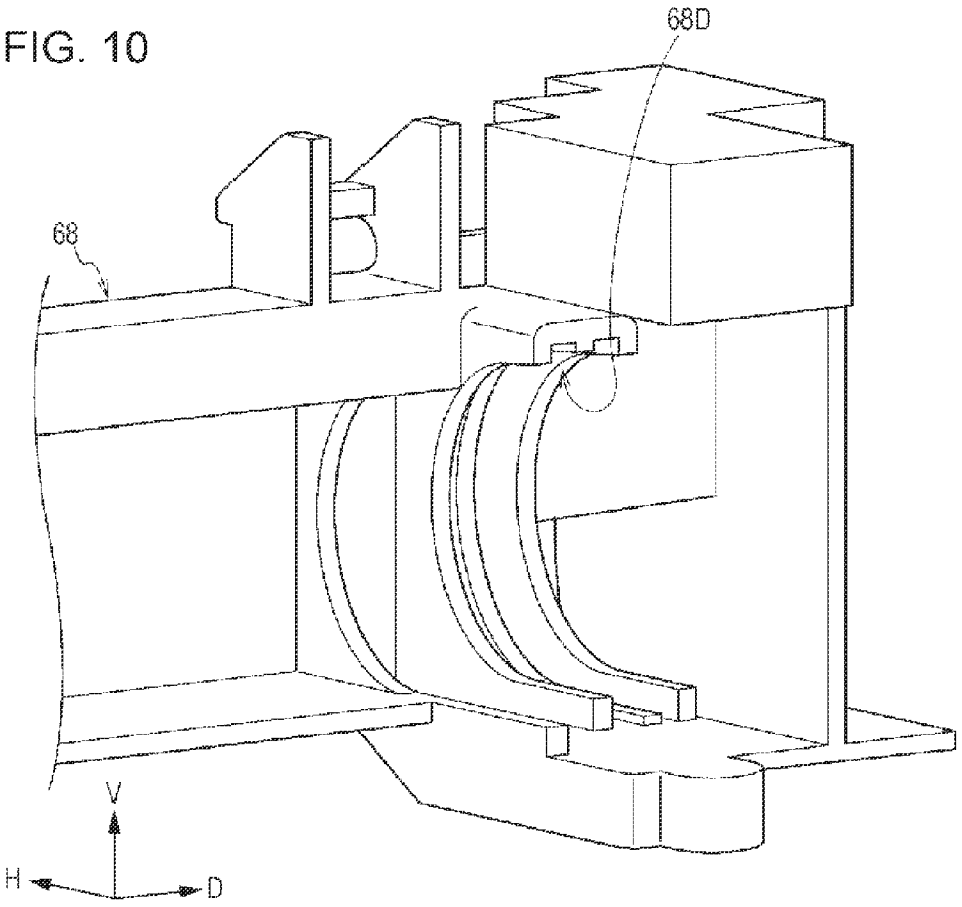
FIG. 10 is an enlarged perspective view showing the fixing device according to the exemplary embodiment of the present invention.

In the first support member 68, as shown in FIGS. 9 and 10, a pair of recessed portions 68D are formed to support the bearings 62C of the heating member 62 (only the recessed portion 68D on one side is shown in FIGS. 9 and 10).

[Pressurizing Member]

Figure 5:
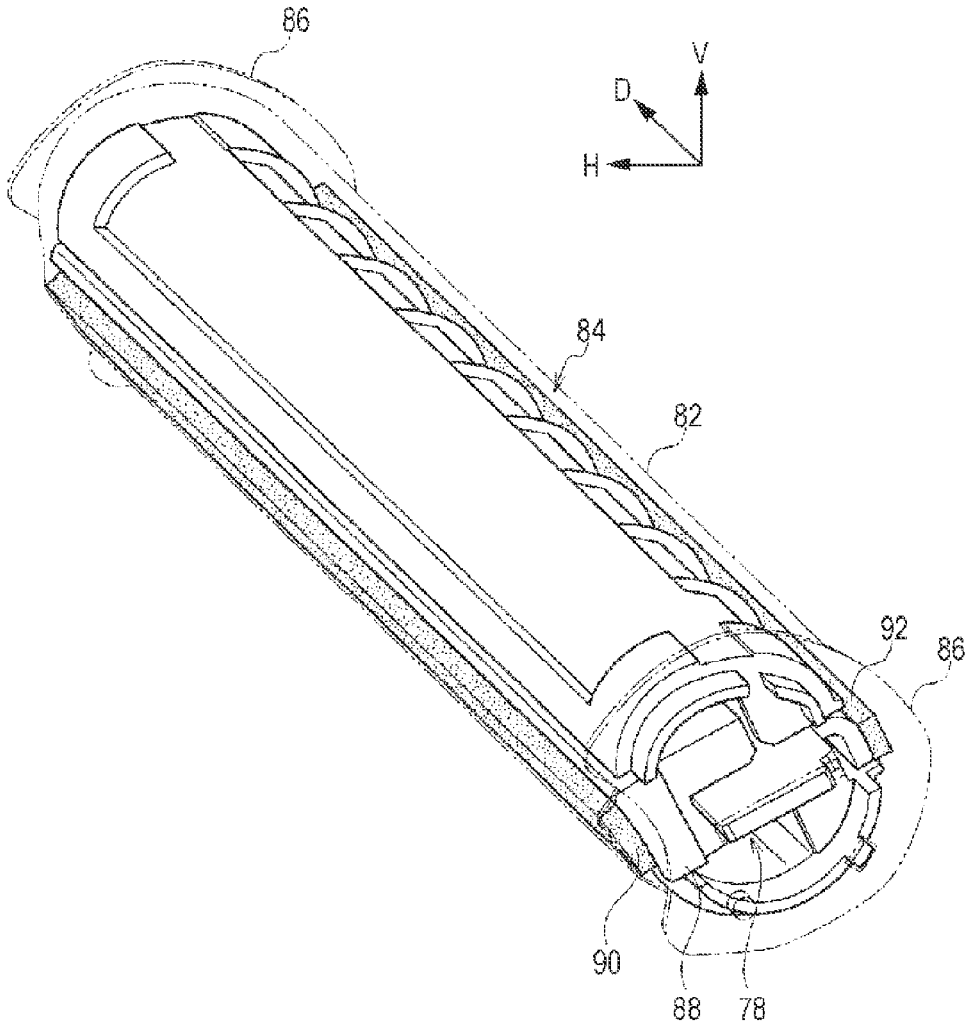
FIG. 5 is a perspective view showing the support mechanism forming the pressurizing member provided in the fixing device according to the exemplary embodiment of the present invention.
Figure 6:
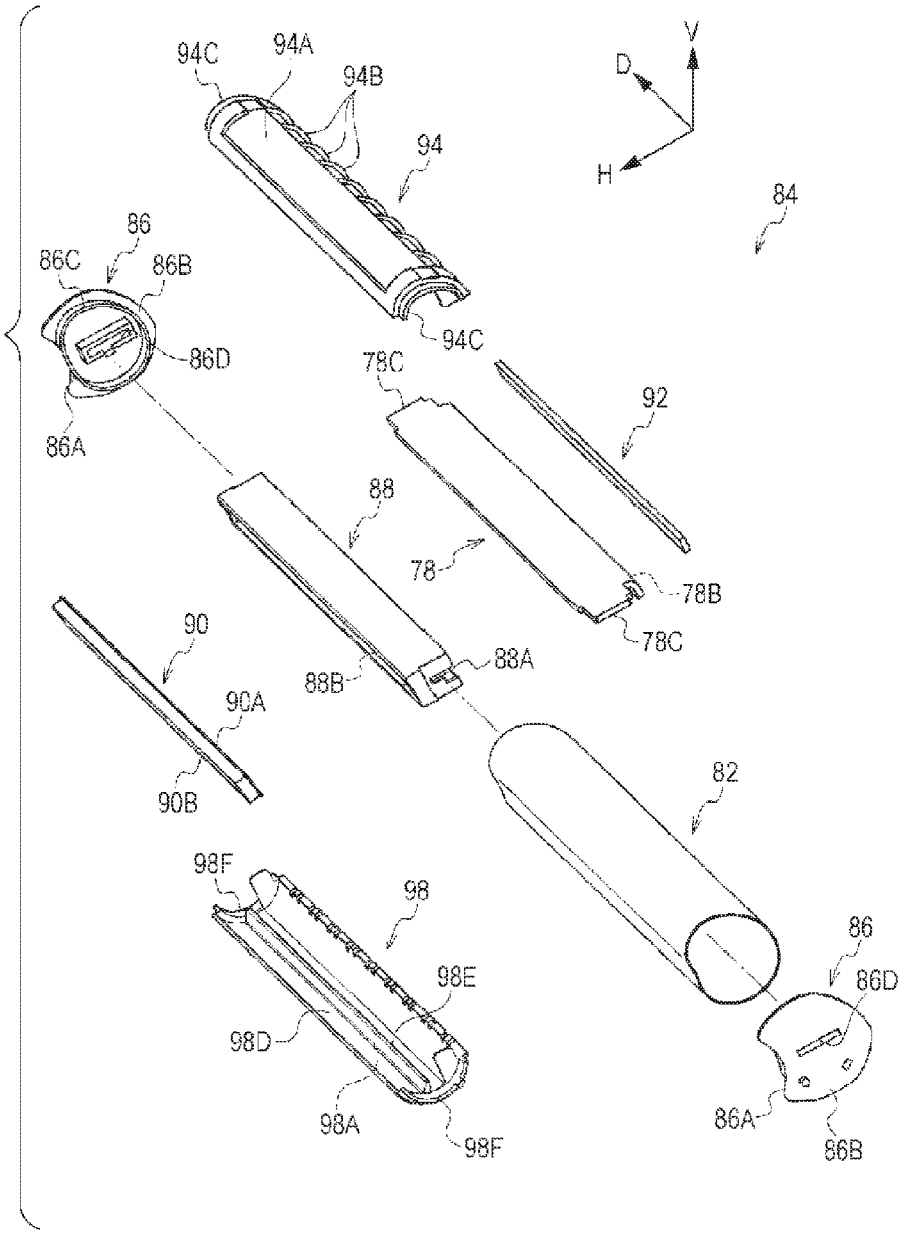
FIG. 6 is an exploded perspective view showing the pressurizing member provided in the fixing device according to the exemplary embodiment of the present invention.
Figure 7:
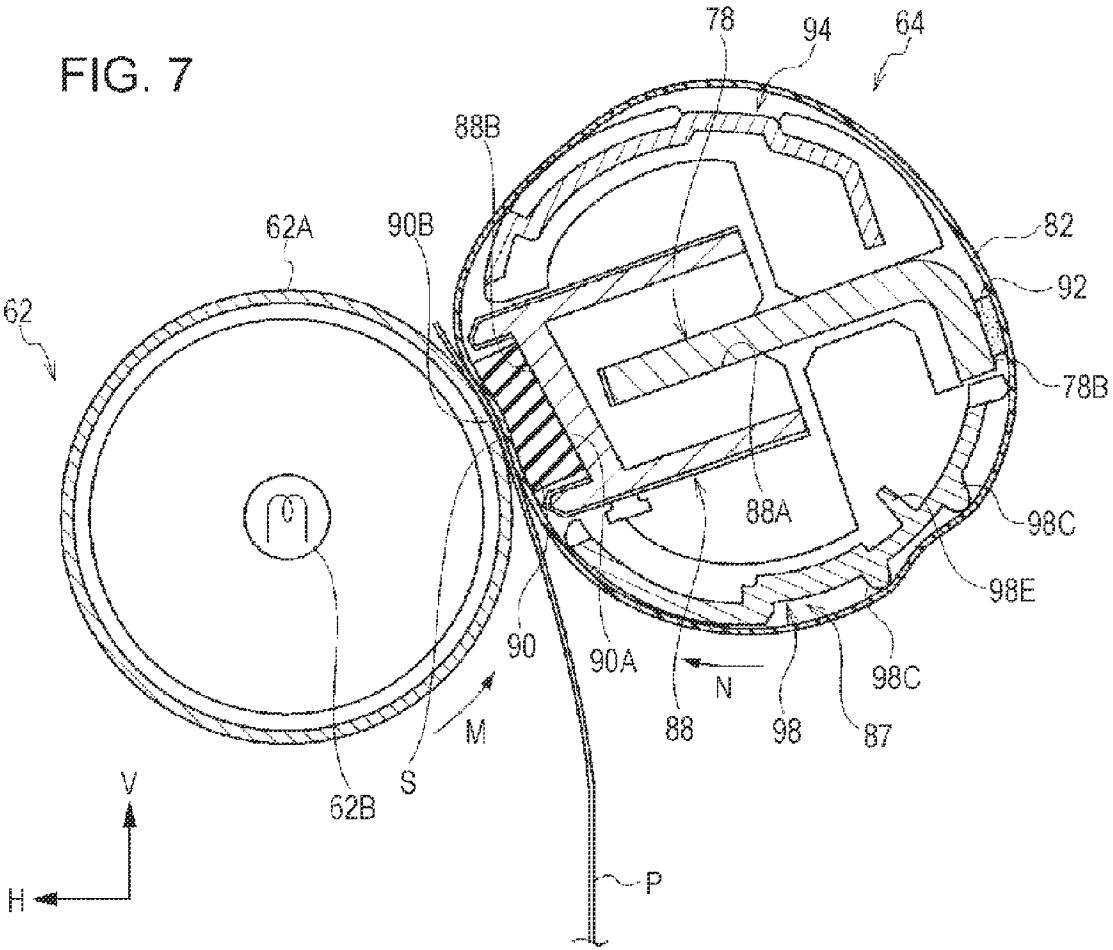
FIG. 7 is an exploded perspective view showing the pressurizing member and a heating member provided in the fixing device according to the exemplary embodiment of the present invention.

As shown in FIGS. 5 and 7, the pressurizing member 64 includes a pressurizing belt 82, a support mechanism 84, and a pair of closure coverings 86 (see FIG. 6). The pressurizing belt 82 serves as an example of an endless (annular) belt member extending in the apparatus depth direction. The support mechanism 84 is disposed inside the pressurizing belt 82 to rotatably support the pressurizing belt 82. The pair of closure coverings 86 are disposed at both ends of the pressurizing belt 82 in the apparatus depth direction to close openings at both ends of the pressurizing belt 82.

[Pressurizing Belt]

The pressurizing belt 82 is shaped from a resin-based material. The pressurizing belt 82 is rotated through contact with the heating member 62 so as to transport the sheet member P with the sheet member P interposed between the pressurizing belt 82 and the heating member 62.

[Support Mechanism]

As shown in FIG. 6, the support mechanism 84 includes a frame 78 shaped by folding a sheet metal. The frame 78 extends in the apparatus depth direction, and has an L-shaped cross section in a direction intersecting the longitudinal direction thereof. Specifically, the plate surface of the frame 78 faces to the vertical direction with the base end side (side opposite to the side on which the heating member 62 is disposed) of the frame 78 bent downward in the vertical direction. A bent surface 78B that faces to the apparatus width direction is formed on the base end side of the frame 78.

The bent surface 78B is formed except at both ends of the frame 78 in the apparatus depth direction. A projecting portion 78C that projects outward through the closure covering 86 is formed at each end of the frame 78 at which the bent surface 78B is not formed. The projecting portion 78C is supported by a recessed portion 70B of the second support member 70 to be discussed later.

The support mechanism 84 further includes a holding member 88 shaped from a resin material, and a pressing member 90 shaped from a rubber material. The holding member 88 extends in the apparatus depth direction, and has a recessed portion 88A formed at the base end to be fitted with the distal end of the frame 78. The pressing member 90 extends in the apparatus depth direction, and is fixed to the distal end of the holding member 88.

Specifically, an attachment surface 88B is formed at the distal end of the holding member 88. The attachment surface 88 extends in the apparatus depth direction, and faces the back surface of the pressurizing belt 82. The pressing member 90 has a rectangular cross section in a direction intersecting the longitudinal direction thereof. A base-end surface 90A of the pressing member 90 is fixed to the attachment surface 88B. A distal-end surface 90B of the pressing member 90 formed opposite to the base-end surface 90A presses (urges) the pressurizing belt 82 against the heating member 62 (see FIG. 7).

The support mechanism 84 additionally includes a felt 92 attached to the bent surface 78B discussed earlier and extending in the apparatus depth direction. The felt 92 is soaked with a lubricant such as oil so that the lubricant is applied to the back surface of the pressurizing belt 82 which rotates.

The support mechanism 84 further includes a semi-cylindrical member 94 shaped from a resin material. The semi-cylindrical member 94 extends in the apparatus depth direction, and is disposed above the frame 78 so as to support the back surface of the pressurizing belt 82 which rotates. Plural ribs 94B are formed on at least a part of an outer peripheral surface 94A of the semi-cylindrical member 94. The ribs 94B extend in the rotational direction of the pressurizing belt 82, and are disposed at intervals in the apparatus depth direction. The distal ends of the ribs 94B and the back surface of the pressurizing belt 82 which rotates contact each other to reduce a slide resistance caused between the pressurizing belt 82 and the semi-cylindrical member 94 compared to a slide resistance caused at a location at which the back surface of the pressurizing belt 82 and the outer peripheral surface 94A contact each other.

A projecting portion 94C is formed at each end of the semi-cylindrical member 94 in the apparatus depth direction. The projecting portion 94C projects in the apparatus depth direction, and is inserted into a cylindrical portion 86C formed in the closure covering 86 to be discussed later.

The support mechanism 84 further includes a semi-cylindrical member 98 shaped from a resin material. The semi-cylindrical member 94 serves as an example of a semi-cylindrical guide member that extends in the apparatus depth direction and that is disposed below the frame 78 so as to support the back surface of the pressurizing belt 82 which rotates.

An outer peripheral surface 98A of the semi-cylindrical member 98 serving as an example of a guide surface guides the pressurizing belt 82 which rotates to a contact portion S (see FIG. 7) between the heating member 62 and the pressurizing member 64. Plural ribs 98B are formed on at least a part of the outer peripheral surface 98A of the semi-cylindrical member 98. As shown in FIG. 1, the ribs 98B serve as an example of rotational-direction projections that extend in the rotational direction of the pressurizing belt 82 and that are disposed at constant intervals in the apparatus depth direction (which is the same as the rotational axis direction of the pressurizing belt 82). The distal ends of the ribs 98B and the back surface of the pressurizing belt 82 which rotates contact each other to reduce a slide resistance caused between the pressurizing belt 82 and the semi-cylindrical member 98 compared to a slide resistance caused at a location at which the back surface of the pressurizing belt 82 and the outer peripheral surface 98A contact each other.

Figure 2:
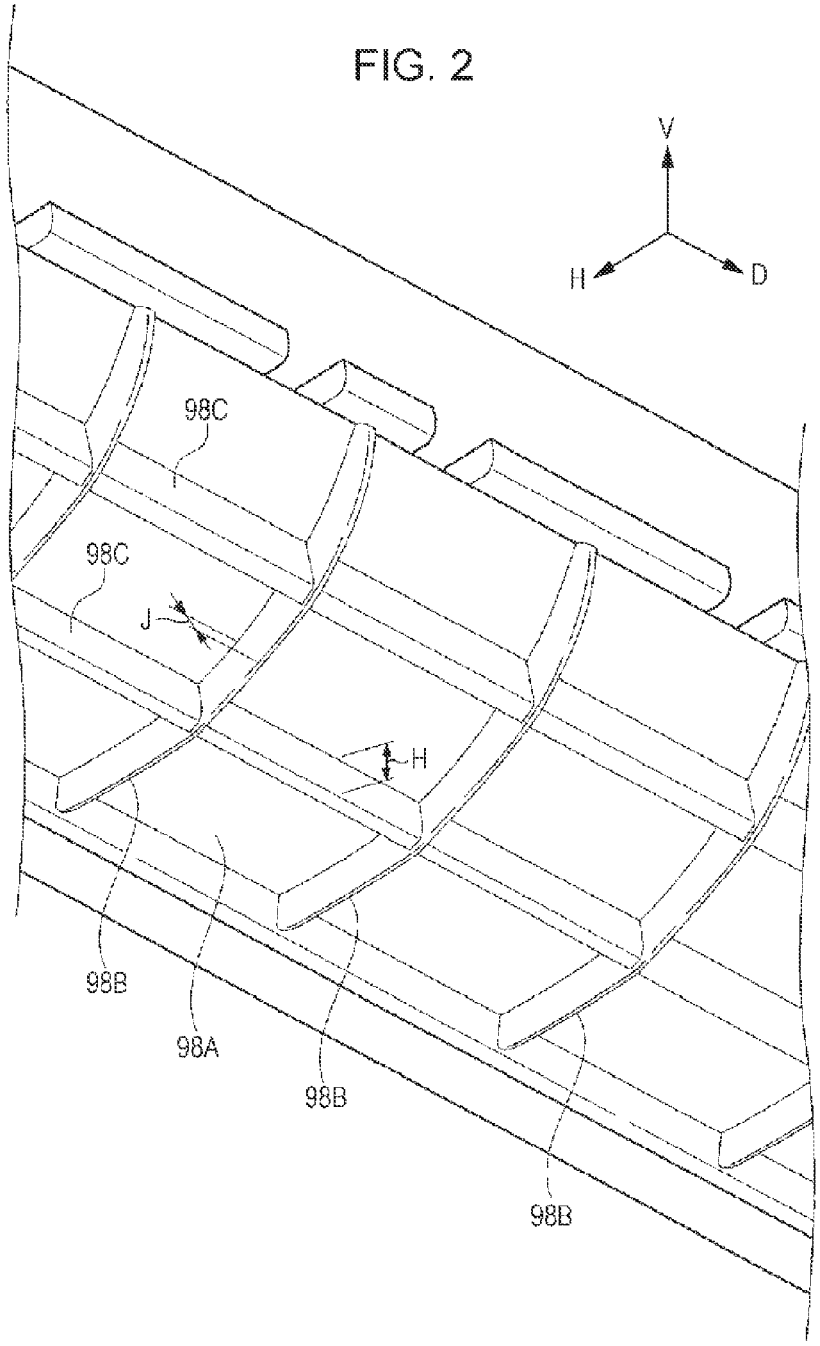
FIG. 2 is an enlarged perspective view showing a semi-cylindrical member forming the support mechanism of the pressurizing member provided in the fixing device according to the exemplary embodiment of the present invention.

In addition, plural ribs 98C are formed on at least a part of the outer peripheral surface 98A of the semi-cylindrical member 98. The ribs 98C serve as an example of intersecting-direction projections that extend along the apparatus depth direction (which is an example of an intersecting direction and which is the same as the rotational axis direction of the pressurizing belt 82) and that are disposed at constant intervals in the rotational direction of the pressurizing belt 82. As shown in FIG. 2, the height (indicated by H in FIG. 2) of the ribs 98C from the outer peripheral surface 98A is equal to or less than (in the exemplary embodiment, less than) the height (indicated by J in FIG. 2) of the ribs 98B from the outer peripheral surface 98A.

Figure 3:
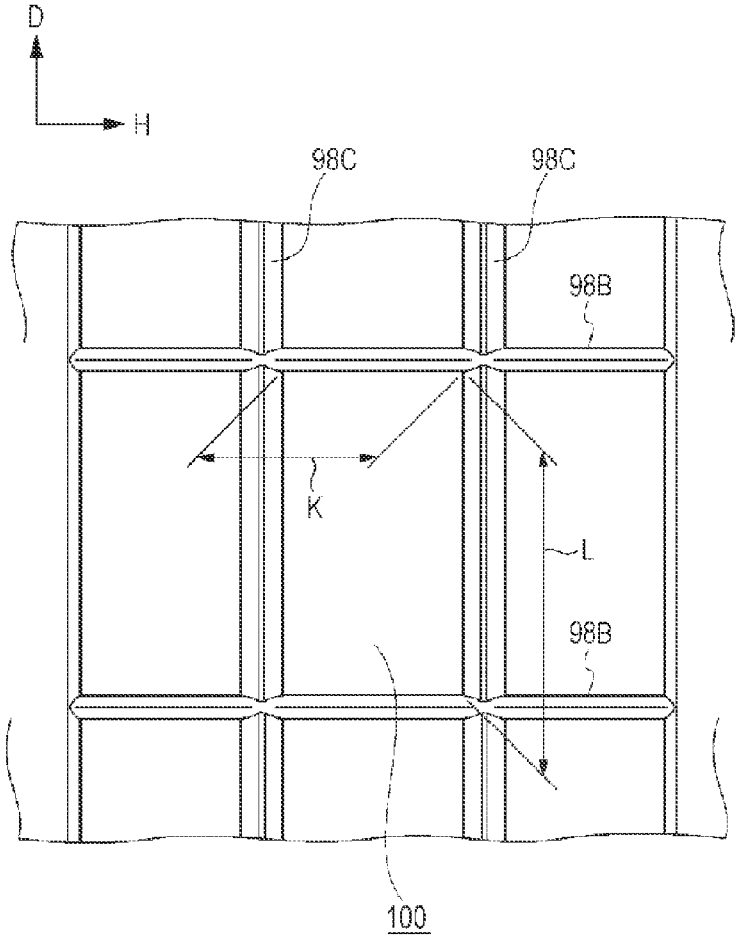
FIG. 3 is a plan view showing the semi-cylindrical member forming the support mechanism of the pressurizing member provided in the fixing device according to the exemplary embodiment of the present invention.

As shown in FIG. 3, further, the length (indicated by K in FIG. 3) of a rectangular portion 100 surrounded by the ribs 98B and the ribs 98C in (along) the rotational direction of the pressurizing belt 82 is equal to or less than (in the exemplary embodiment, less than) the length (indicated by L in FIG. 3) of the rectangular portion 100 in the apparatus depth direction (which is the same as the rotational axis direction of the pressurizing belt 82).

As shown in FIG. 6, in addition, a rib 98E is formed on an opposite surface 98D of the semi-cylindrical member 98 opposite to the outer peripheral surface 98A. The rib 98E serves as an example of an opposite projection extending along the apparatus depth direction.

A projecting portion 98F is formed at each end of the semi-cylindrical member 98 in the apparatus depth direction. The projecting portion 98F projects in the apparatus depth direction, and is inserted into a cylindrical portion 86C formed in the closure covering 86 to be discussed later.

[Closure Covering]

The closure covering 86 disposed at each end of the pressurizing belt 82 is a plate-shaped member shaped from a resin material and oriented with its plate thickness direction matching the apparatus depth direction as shown in FIG. 6.

An arcuate portion 86A is formed on the side of the closure covering 86 facing the heating member 62 (see FIG. 7). The arcuate portion 86A is an arcuate notch provided to avoid interference with the heating member 62.

The cylindrical portion 86C is formed to project from an inside surface 86B (surface facing to the pressurizing belt 82) of the closure covering 86 as seen in the apparatus depth direction. The projecting portion 94C and the projecting portion 98F discussed earlier are inserted into the cylindrical portion 86C to position the semi-cylindrical member 94 and the semi-cylindrical member 98.

A rectangular through hole 86D is formed in a portion of the closure covering 86 surrounded by the cylindrical portion 86C. The through hole 86D penetrates between the front and back sides of the closure covering 86, and allows the projecting portion 78C of the frame 78 discussed earlier to pass therethrough.

[Second Support Member]

The second support member 70 is shaped from a sheet metal member, and disposed at each end of the pressurizing member 64 in the apparatus depth direction as shown in FIGS. 12 and 14.

Figure 8:
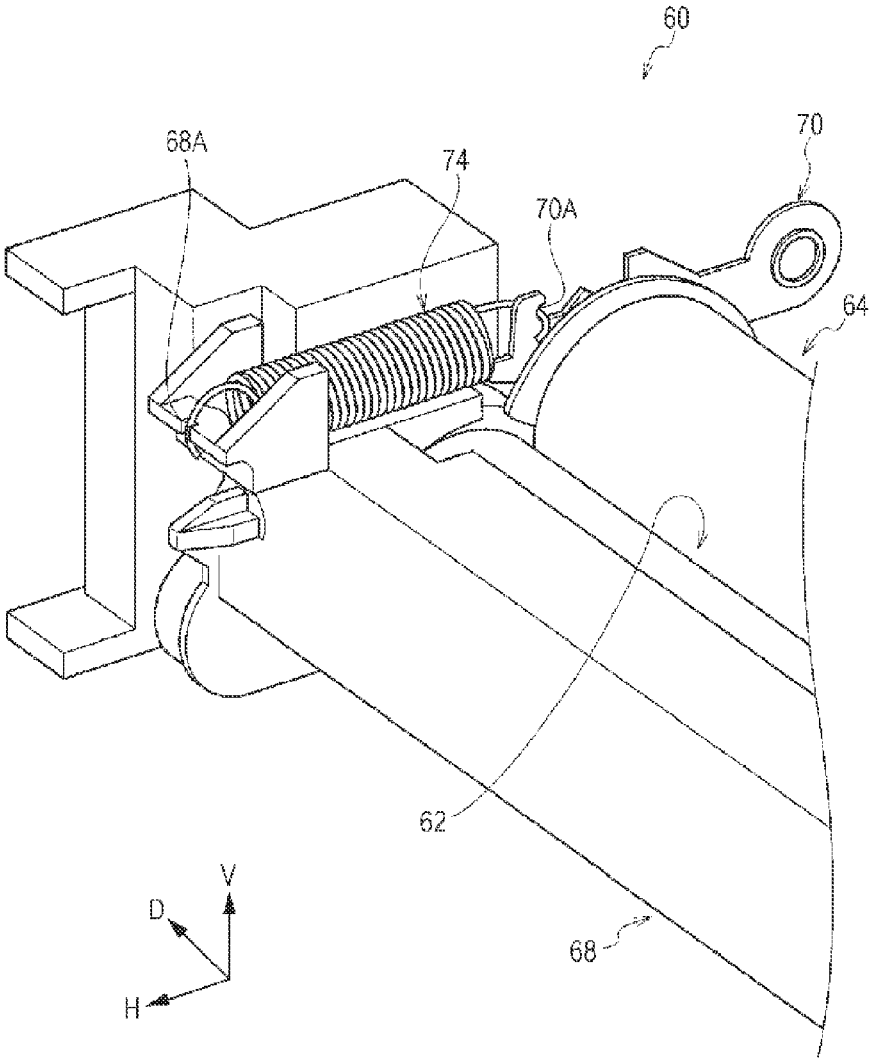
FIG. 8 is an enlarged perspective view showing the fixing device according to the exemplary embodiment of the present invention.
Figure 13A:
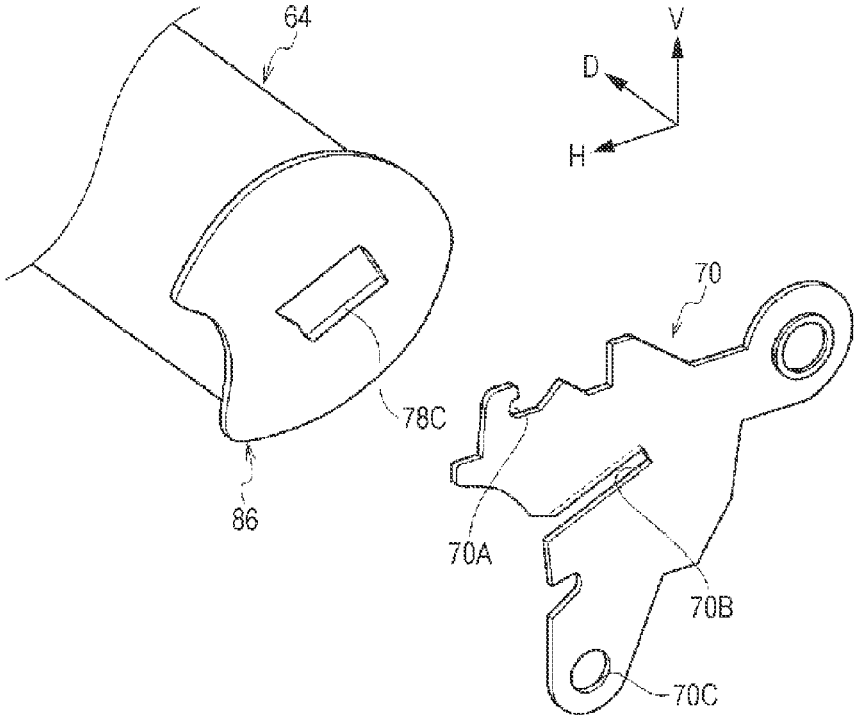
FIGS. 13A and 13B are each an enlarged perspective view showing a part of the pressurizing member provided in the fixing device according to the exemplary embodiment of the present invention.
Figure 13B:
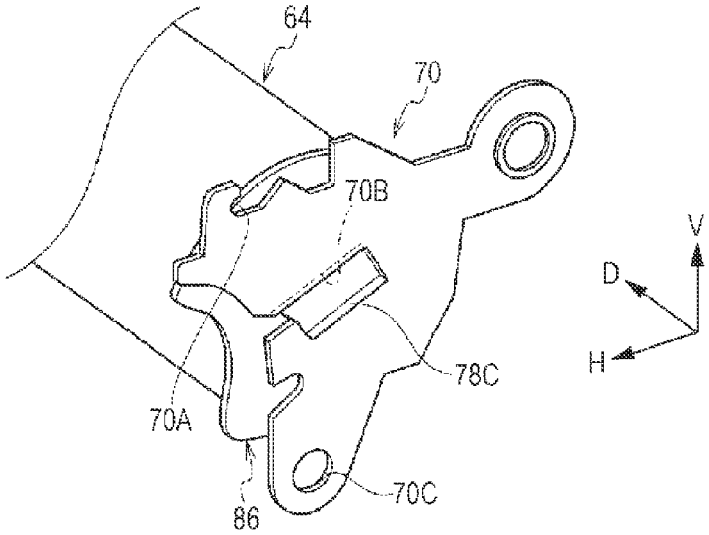

As shown in FIGS. 8 and 14, the retaining portion 70A is formed in the second support member 70. The other end of the spring 74 is retained at the retaining portion 70A. As shown in FIGS. 13A and 13B, further, the recessed portion 70B is formed in the second support member 70 below the retaining portion 70A. The recessed portion 70B supports the projecting portion 78C of the frame 78 discussed earlier.

Figure 11:
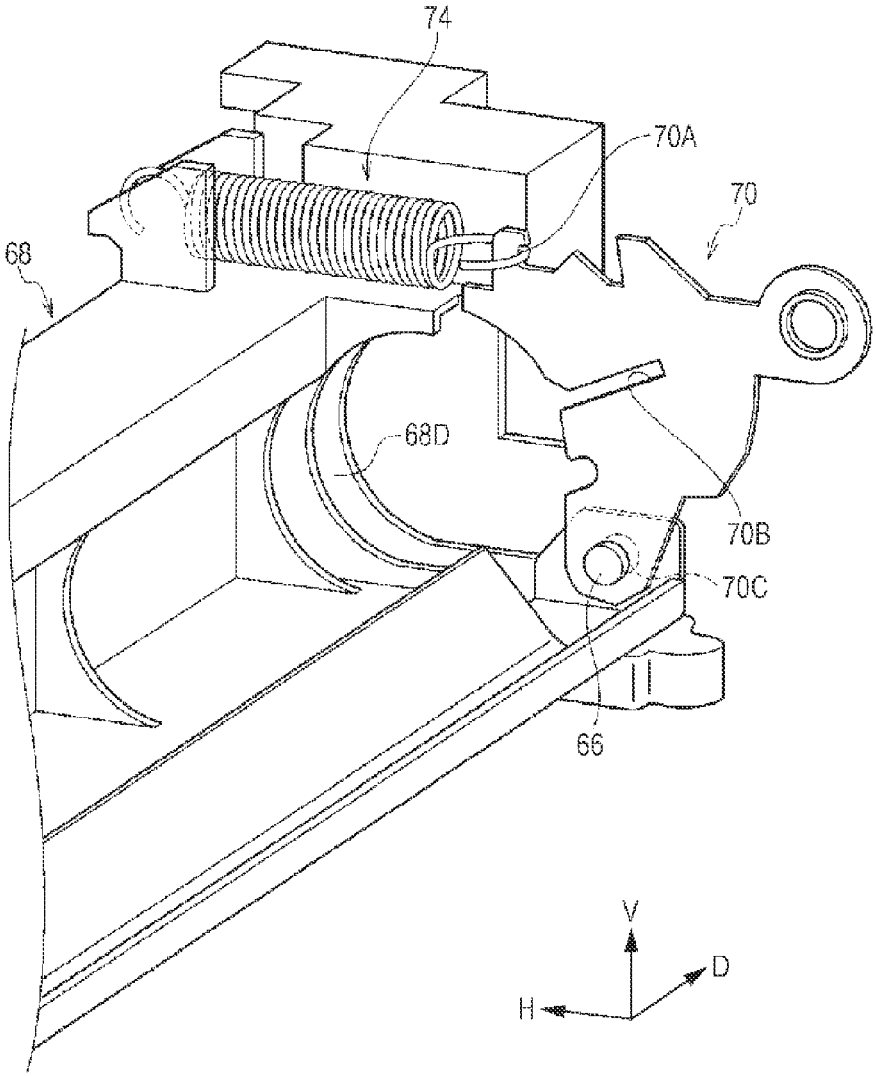
FIG. 11 is an enlarged perspective view showing the fixing device according to the exemplary embodiment of the present invention.

As shown in FIG. 11, in addition, a circular portion 70C is formed in the second support member 70 below the recessed portion 70B. The circular portion 70C is a circular hole to be rotatably (movably) retained on a pin 66 provided on the first support member 68.

The pin 66 extending in the apparatus depth direction is inserted into the circular portion 70C so that the second support member 70 is rotatably retained (held) with respect to the first support member 68.

(Function of Fixing Device)

Next, the function of the fixing device 60 will be described.

As shown in FIG. 7, a rotational force is transmitted from a motor (not shown) to the heating member 62 provided in the fixing device 60 so as to rotate the heating member 62 in the direction indicated by the arrow M.

Further, the pressurizing belt 82 of the pressurizing member 64 pressed against the outer peripheral surface of the heating member 62 is driven by the heating member 62 and rotates in the direction indicated by the arrow N. The sheet member P to which a toner image has been transferred is transported while being interposed between the heating member 62 and the pressurizing member 64 which rotate so that the toner image which has been transferred to the sheet member P is fixed to the sheet member P.

It is assumed that the sheet member P to which the toner image has been transferred has a width smaller than the maximum width of the sheet member P supported by the fixing device 60 and a thickness larger than that of regular paper (for example, the sheet member P is postcard paper). A part of the pressurizing belt 82 contacts the sheet member P during rotation, while another part of the pressurizing belt 82 contacts the heating member 62 during rotation.

In the case where the sheet member P has a small width and a large thickness as discussed earlier, the apparent outside diameter of the part of the heating member 62 which contacts the sheet member P is increased by an amount corresponding to the thickness of the sheet member P. This leads to a difference in peripheral velocity between the part of the pressurizing belt 82 which contacts the sheet member P during rotation and the part of the pressurizing belt 82 which contacts the heating member 62 during rotation.

Such a difference in peripheral velocity may cause a concave deformation in the surface of the pressurizing belt 82. The concave deformation may be moved along with rotation of the pressurizing belt 82, and caught between the heating member 62 and the pressing member 90 to be collapsed, reducing the service life of the pressurizing belt 82. In addition, a sound may be generated when such a concave deformation appears or disappears.

As discussed earlier, however, the ribs 98C extending in the apparatus depth direction are formed on the outer peripheral surface 98A of the semi-cylindrical member 98. Therefore, the concave deformation caused in the pressurizing belt 82 is pushed up by the ribs 98C from the back surface of the pressurizing belt 82 as the concave deformation passes over the ribs 98C. The concave deformation is thus eliminated before being caught between the heating member 62 and the pressing member 90 to be collapsed.

As discussed earlier, the ribs 98C extend along the apparatus depth direction (rotational axis direction). This allows the concave deformation which contacts the ribs 98C to be effectively pushed up by the ribs 98C to be eliminated without being moved in the apparatus depth direction in contrast to a case where the ribs 98C are inclined with respect to the apparatus depth direction.

Figure 4A:
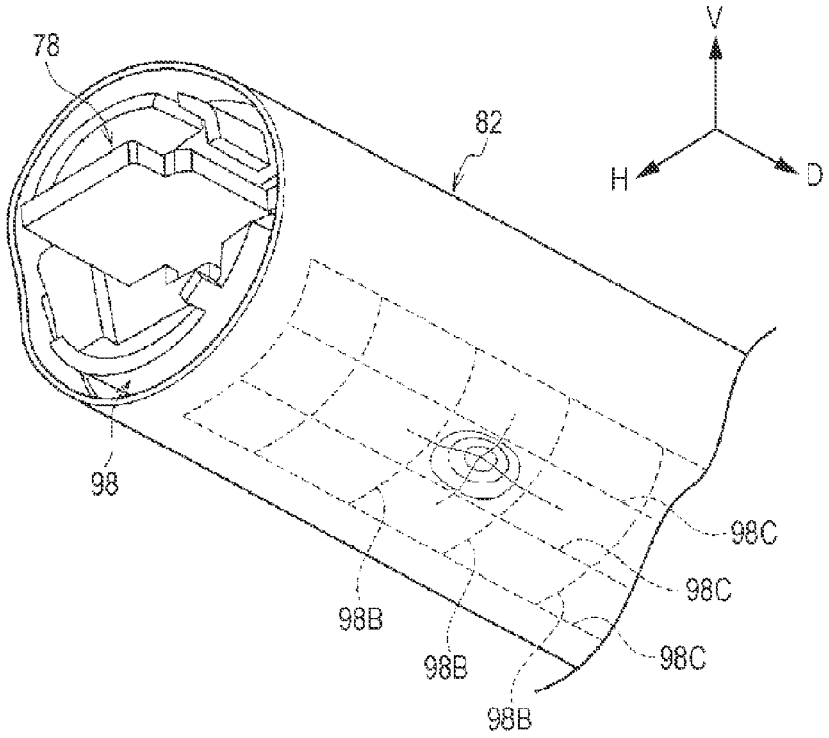
FIGS. 4A and 4B are an enlarged perspective view and an enlarged cross-sectional view, respectively, showing the support mechanism forming the pressurizing member provided in the fixing device according to the exemplary embodiment of the present invention.
Figure 4B:
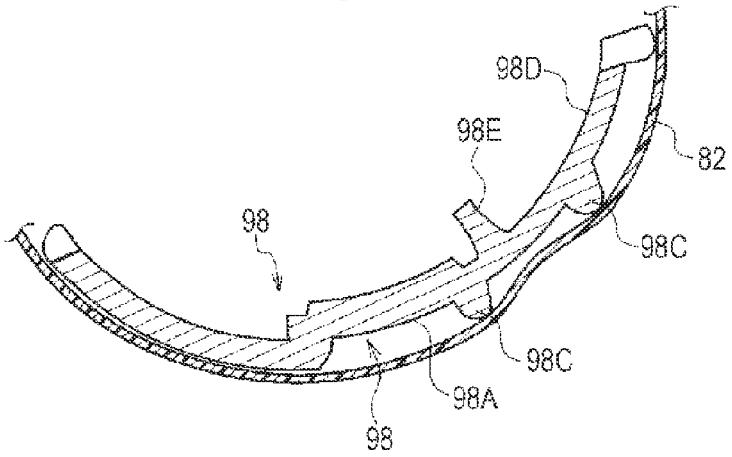

As discussed earlier, the length (indicated by K in FIG. 3) of the rectangular portion 100 surrounded by the ribs 98B and the ribs 98C in the rotational direction of the pressurizing belt 82 is equal to or less than the length (indicated by L in FIG. 3) of the rectangular portion 100 in the apparatus depth direction. Therefore, in the case where the concave deformation has a circular shape in plan view, the concave deformation is caused in the pressurizing belt 82 at a position between a pair of adjacent ribs 98C as shown in FIGS. 4A and 4B, and the concave deformation is not moved from the position even when the pressurizing belt 82 is rotated (the concave deformation appears and disappears at the same position, and the concave deformation is apparently caused at a constant position). That is, the concave deformation is caused at the same position at all times, suppressing appearance and disappearance of the concave deformation.

As discussed earlier, the height (indicated by H in FIG. 2) of the ribs 98C from the outer peripheral surface 98A is equal to or less than the height (indicated by J in FIG. 2) of the ribs 98B from the outer peripheral surface 98A.

As discussed earlier, the rib 98E extending in the apparatus depth direction is formed on the opposite surface 98D of the semi-cylindrical member 98.

While a specific exemplary embodiment of the present invention has been described in detail above, the present invention is not limited to such an exemplary embodiment. It is apparent to those skilled in the art that a variety of other exemplary embodiments may fall within the scope of the present invention. For example, while plural ribs 98C are formed on the outer peripheral surface 98A of the semi-cylindrical member 98 in the exemplary embodiment described above, only one rib 98C may be formed thereon.

While the ribs 98C are formed on the outer peripheral surface 98A of the semi-cylindrical member 98 to extend along the rotational axis direction of the heating member 62 in the exemplary embodiment described above, the direction of the ribs 98C is not limited to that particular direction. The ribs 98C may be formed to extend in any direction that intersects the ribs 98B.

In the exemplary embodiment described above, the heating member 62 serves as a fixing member. However, the pressurizing member 64 may serve as a fixing member in a reverse configuration.

What is claimed is:

1. A fixing device comprising:

a fixing member that transports a recording medium on which a toner image has been transferred to fix the toner image to the recording medium;

an endless belt member that rotates with a front surface of the belt member contacting the fixing member;

a guide member that guides the belt member to a contact portion at which the belt member and the fixing member contact each other;

a plurality of rotational-direction projections formed on a guide surface of the guide member facing a back surface of the belt member and disposed at intervals in a rotational axis direction of the belt member, the rotational-direction projections extending in a rotational direction of the belt member and projecting toward the back surface of the belt member; and a plurality of intersecting-direction projections formed on the guide surface, the intersecting-direction projections extending along an intersecting direction that intersect the rotational-direction projections and projecting toward the back surface of the belt member, wherein the rotational-direction projections and the intersecting-direction projections form a plurality of rectangular portions along the rotational direction, wherein the rotational-direction projections and the intersecting-direction projection contact withy the endless belt member.

2. The fixing device according to claim 1, wherein the intersecting direction extends along the rotational axis direction.

3. The fixing device according to claim 2, wherein a a length in the rotational direction of a rectangular portion surrounded by the rotational-direction projections and the intersecting-direction projections is equal to or less than a length of the rectangular portion in the rotational axis direction.

4. The fixing device according to claim 2, wherein the guide member has a shape of a plate that is curved as seen from the rotational axis direction, and an opposite projection is formed on an opposite surface of the guide surface opposite to the guide surface, the opposite projection extending along the intersecting direction and projecting from the opposite surface.

5. The fixing device according to claim 3, wherein the guide member has a shape of a plate that is curved as seen from the rotational axis direction, and an opposite projection is formed on an opposite surface of the guide surface opposite to the guide surface, the opposite projection extending along the intersecting direction and projecting from the opposite surface.

6. The fixing device according to claim 1, wherein a lenght in the rotational direction of a rectangular portion surrounded by the rotational-direction projections and the intersecting-direction projections is equal to or less than a length of the rectangular portion in the rotational axis direction.

7. The fixing device according to claim 6, wherein the guide member has a shape of a plate that is curved as seen from the rotational axis direction, and an opposite projection is formed on an opposite surface of the guide surface opposite to the guide surface, the opposite projection extending along the intersecting direction and projecting from the opposite surface.

8. The fixing device according to claim 1, wherein the guide member has a shape of a plate that is curved as seen from the rotational axis direction, and an opposite projection is formed on an opposite surface of the guide surface opposite to the guide surface, the opposite projection extending along the intersecting direction and projecting from the opposite surface.

9. The fixing device according to claim 1, wherein the guide member has a shape of a plate that is curved as seen from the rotational axis direction, and an opposite projection is formed on an opposite surface of the guide surface opposite to the guide surface, the opposite projection extending along the intersecting direction and projecting from the opposite surface.

10. An image forming apparatus comprising:

a transfer member that transfers a toner image to a recording medium; and a fixing device according to claim 1 that fixes the toner image which has been transferred to the recording medium by the transfer member to the recording medium.

* * * * *